United States Patent [19]

Glynn

[11] Patent Number: 4,586,500

[45] Date of Patent: May 6, 1986

[54] BREATHING APPARATUS

[75] Inventor: Michael H. Glynn, Heckfield, Great Britain

[73] Assignee: Sabre Safety Limited, Hampshire, England

[21] Appl. No.: 504,160

[22] Filed: Jun. 14, 1983

[30] Foreign Application Priority Data

Jun. 14, 1982 [GB] United Kingdom ..... 8217211

[51] Int. Cl.[4] ..... A62B 7/00

[52] U.S. Cl. ..... 128/204.15; 62/259.3; 62/514 R

[58] Field of Search ..... 62/259.3, 514 R; 128/204.15, 204.16, 204.17, 204.18

[56] References Cited

U.S. PATENT DOCUMENTS

| | | | |
|---|---|---|---|
| 3,714,942 | 2/1973 | Fischel et al. | 128/204.16 X |
| 4,314,566 | 2/1982 | Kiwak | 62/514 R |
| 4,370,192 | 1/1983 | Cooley | 62/514 R |

FOREIGN PATENT DOCUMENTS

| | | | |
|---|---|---|---|
| 952858 | 3/1964 | United Kingdom | 128/204.15 |
| 983423 | 2/1965 | United Kingdom | 128/204.15 |
| 1194944 | 6/1970 | United Kingdom | 128/204.15 |
| 1235541 | 6/1971 | United Kingdom | 128/204.15 |
| 1581589 | 12/1980 | United Kingdom | 128/204.15 |
| 1581588 | 12/1980 | United Kingdom | 128/204.15 |

*Primary Examiner*—Henry Bennett

*Attorney, Agent, or Firm*—Cushman, Darby & Cushman

[57] ABSTRACT

In a breathing apparatus of the closed circuit type wherein breathable air is recirculated with the removal of carbon dioxide and the replenishment of oxygen, the breathable air is cooled by causing it to flow through a conduit in heat exchange relationship with a reservoir containing a liquid refrigerant medium which has a boiling point below the maximum desired temperature of the breathable air supply. The reservoir is vented to allow escape of refrigerant gas through an adjustable pressure relief valve, whereby cooling of the breathable air supply is effected through a progressive boiling away of the refrigerant liquid from the reservoir, the boiling point of the liquid being controlled by means of a corresponding adjustment of the pressure relief valve.

9 Claims, 6 Drawing Figures

BREATHING APPARATUS

BACKGROUND OF THE INVENTION

Figure 1:
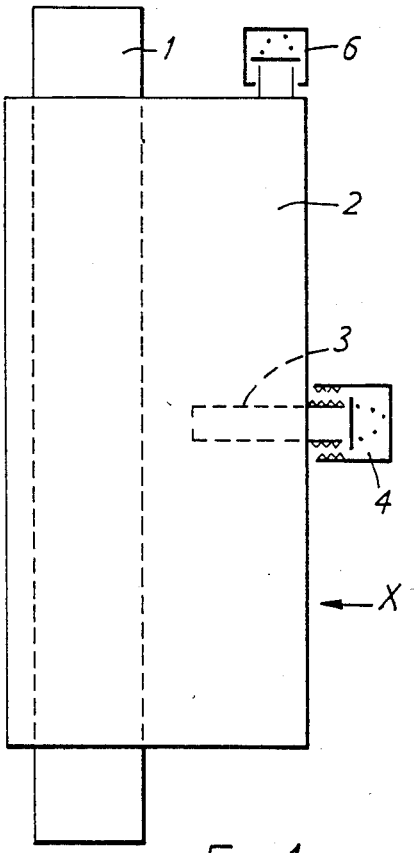

This invention concerns improvements in or relating to breathing apparatus.

There are two main types of breathing apparatus in use at the present time. One type consists of an air or other respirable gas supply from a cylinder controlled by a demand valve, operated by the wearer (commonly called open circuit type). In this type the full volume of each breath is taken from the cylinder. The British Standard test for breathing apparatus specifies a minute volume of breathing of 40 liters a minute (BS 4667 1974). This has been shown to accurately reflect that actually needed in practice. For practical purposes the largest size oxygen cylinder a man can carry in a breathing apparatus has 2000 liters of air in it and this charged weights some 15 kilograms. It is seen from these figures that the maximum duration of this type of breathing apparatus is 60 minutes at this flow.

When the requirement for a breathing apparatus is for a longer duration of up to 4 hours, a second type of breathing apparatus is used. This type of apparatus, commonly referred to as the closed circuit type, consists of an oxygen cylinder or other oxygen supply feeding into a recirculating system. The circuit of this system includes a reservoir bag and a carbon dioxide absorber, together with non-return and relief valves. This system is well known and has the advantage that the oxygen supply from the cylinder can now be at the rate absorbed by the wearer's lungs and is approximately 1–3 liters per minute depending on activity. This means that the oxygen used for a 4 hour duration is now only 720 liters maximum (at 3 liters per minute) giving a large weight saving. The disadvantage of all known systems of this type, however, is that the absorption of carbon dioxide by an absorbent material, usually soda lime in a cannister, involves an exothermic reaction. The amount of heat produced by this reaction is of the order of 1000 calories per minute for the figures given earlier, and thus the medium breathed by the wearer of the apparatus is correspondingly heated.

As breathing apparatus is commonly used in hot environments such as fires or mines, this heat is not easily dissipated and consequently places a physiological strain on the wearer. The British Standard test mentioned earlier specifies an inhaled oxygen temperature of less than 40° C. in an ambient of 30° C. 85–90% relative humidity. It has been shown that if this inhaled oxygen temperature could be reduced below the body temperature of 37° C., great benefit would result for the wearer, as he would now pass heat to the apparatus instead of taking heat from it. Many methods to achieve this have been tried, for example, coolers using latent heat of fusion of ice or other substances, but these to be effective are too heavy for the wearer. Evaporation of water has been also tried but as the relative humidity of the environment is high, elevated flows of oxygen are needed in combination with this, again producing too heavy an apparatus.

SUMMARY OF THE INVENTION

It is an object of the invention to overcome at least some of the disadvantages of the known breathing apparatus referred to above by providing a simple and readily portable means of cooling the medium to be breathed, for example in a breathing apparatus of the kind wherein the breathed medium is to be recycled.

It is a further object of the invention to provide an improved breathing apparatus incorporating such means for cooling a breathing medium.

In accordance with the invention, a breathable medium is cooled by passing the medium through a conduit in heat exchange relationship with a reservoir containing a liquid in which has a boiling point below the maximum desired temperature of the breathable medium, said reservoir being vented to allow escape of liquid vapour therefrom, whereby cooling of said breathable medium passing through said conduit is effected through a progressive boiling away of the liquid from said reservoir, and means being provided for controlling the vapour pressure within said reservoir and thus the boiling point of said medium, whereby the temperature of said medium is correspondingly controlled.

There are available a variety of non-inflammable and non-toxic refrigerant media which satisfy the requirement for a liquid to be used in accordance with the invention, which can be stored under their own vapour pressure, and the latent heat of evaporation of which enable effective cooling of the breathable medium.

Examples of suitable refrigerant media are:

| Formula: | Designated: | Boiling point at atmospheric pressure: |
|---|---|---|
| $CCl_3F$ | R 11 | 23.7° C. |
| $CHCl_2F$ | R 21 | 8.9° C. |
| $C_2Cl_2F_4$ | R 114 | 3.6° C. |

The refrigerant medium and the operating pressure of the pressure release valve should be selected in such a combination as to provide for boiling-off of the liquid at an appropriate temperature of the breathable medium. The latent heat of vaporisation of the liquids referred to above is such that less than 1 kilogram of liquid is evaporated during the normal duration of the apparatus.

In accordance with a preferred feature of the invention, the pressure release valve is manually adjustable to provide means for optionally controlling the temperature of the breathable medium. This gives the enormous advantage that the wearer of a breathing apparatus can himself set the temperature of the inhaled medium by a control on the apparatus and can vary this to suit his needs in varying ambient temperatures. For example, he can select a lower inhaled oxygen temperature in high environmental temperatures and promote body cooling. The boiling point of R11 at 2 bar absolute pressure is 45° C. This gives a blow-off value and reservoir pressure of only 15 P.S.I. (1 bar) above atmospheric pressure so that this agent alone gives a range of 23.7°–45° C. over the pressure range of 0 to 15 P.S.I. above atmospheric pressure.

The invention further provides a cooling device for use in the method of the invention comprising a fluid flow conduit, a reservoir in heat exchange relationship with said conduit, a body of liquid contained within said reservoir, and pressure relief value means for venting said reservoir to atmosphere. The said conduit may consist of a tube or other vessel with an adequate surface area in the breathing circuit in thermal contact with the reservoir of liquid. The boiling point of the liquid may then be selected in accordance with the vapour pressure curve for this liquid and the pressure maintained in the reservoir by adjustment of the pressure relief valve which may be under the control of the wearer.

The device in accordance with the invention can be stored fully charged ready for instant use. The reservoir can be constructed in one or more parts so that the refrigerant liquid is either inside or outside the breathing circuit tube or vessel. It can also be constructed on the principles of the "non-spill inkwell" so that it is not filled to more than 50% of its volume. The blow-off outlet is then located in the centre point of the reservoir so that the wearer can assume any position, such as head down, without loss of liquid.

The cooling device in accordance with the invention can be incorporated as a part of a complete breathing equipment or may be adapted for adding to existing breathing apparatus. Moreover, although the device is primarily intended for use with breathing apparatus, it will be appreciated that it may also have other uses where the cooling of fluid medium is desirable.

Figure 2:
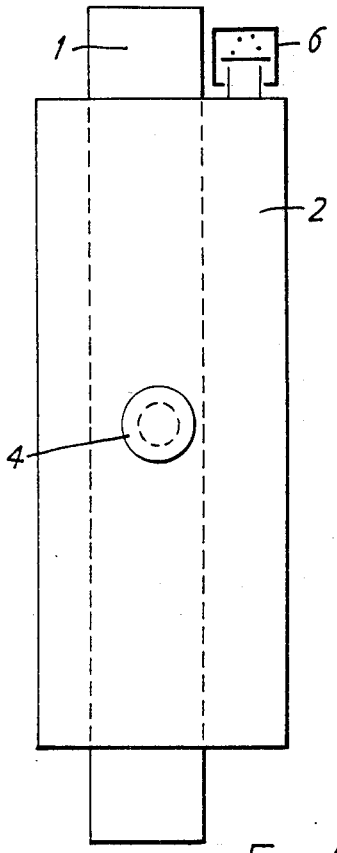
Figure 3:
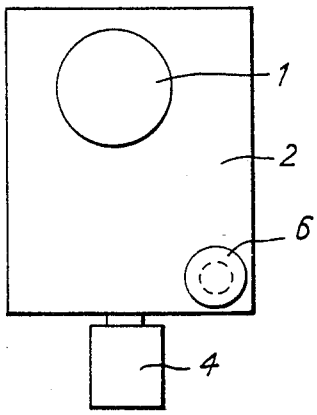
Figure 6:
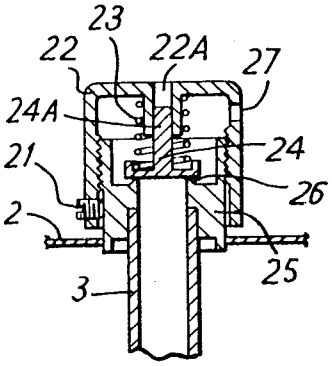
Figure 5:
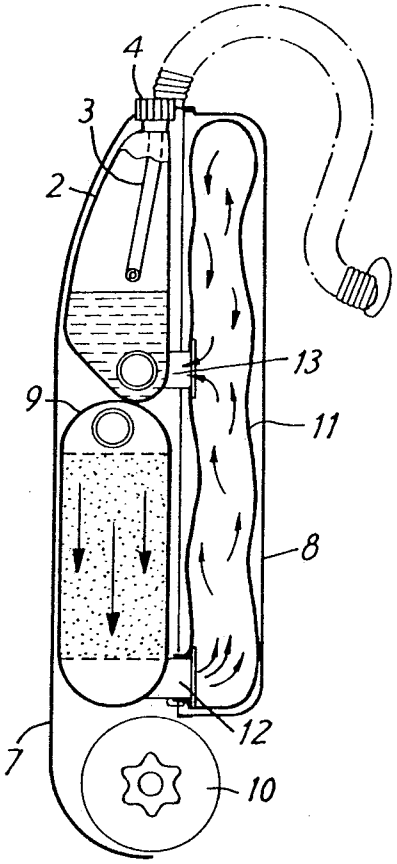
Figure 4:
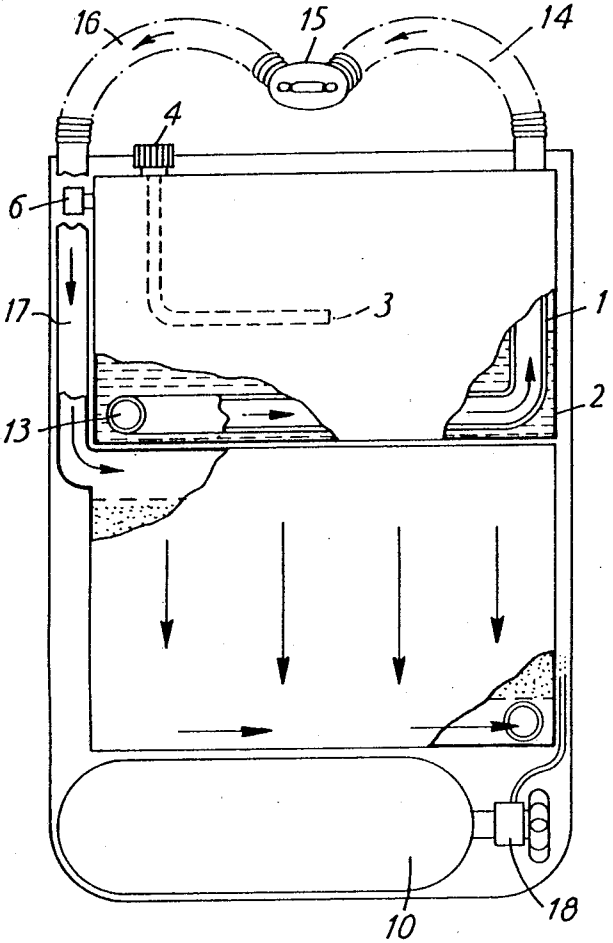

FIG. 1 is a side view of the one embodiment of a cooling device in accordance with the invention that may be incorporated into a standard breathing apparatus circuit, FIG. 2 is a view corresponding to FIG. 1 in the direction of the arrow X in FIG. 1, FIG. 3 is a plan view corresponding to FIG. 2, FIG. 4 is a front elevation, partly in section, of a breathing apparatus in accordance with the invention incorporating a cooling device, FIG. 5 is a side elevation, partly in section, of the device shown in FIG. 4, and FIG. 6 is a fragmentary cross section of a pressure relief valve of the kind utilised in the devices shown in FIGS. 1–3 and FIGS. 4 and 5 respectively.

Referring to FIGS. 1–3 of the drawings, a tube 1 for connection into the circuit of a breathing apparatus passes through a reservoir vessel 2. The tube 1 may have fins, balls, wire wool or other means inside to increase the surface area for heat exchange with the breathable medium. The tube 1 is set off centre so that the inner end of a filling and venting tube 3 is located in the volumetric centre of the reservoir, so that when the reservoir is half-filled through the tube 3 it can be turned in any direction without loss of liquid from a pressure relief valve 4 located on the outer end of the tube 3. This valve 4 can be adjusted so that the liquid is stored under its own vapour pressure. The valve 4 also serves to adjust the temperature of the boiling point of the liquid as described above and can be removed for filling of the reservoir 2. A safety valve 6 is incorporated should the apparatus be located in a very high temperature such as a store fire. This may also serve as a means to empty the reservoir to change the liquid. The vapour leaving the valve 4 may be used in a manner not shown to cool other parts of the breathing apparatus or face mask or may be used to lower the fire risk of high oxygen concentrations at special locations in the apparatus, such as the breathing circuit relief valve.

Referring now to FIGS. 4–6 of the drawings, there is shown a further embodiment of the invention wherein a cooling device of the kind generally described above is incorporated into a practical embodiment of a recirculatory type of breathing apparatus. Those parts of the apparatus that correspond to similar parts of the device shown in FIGS. 1–3 have been designated by the same reference numerals.

The breathing apparatus comprises an outer casing formed by two opposed panel members 7 and 8 of dished configuration, the member 7 serving to support the reservoir 2 of refrigerant, as well as a canister 9 containing a carbon dioxide absorbing medium, and an oxygen cylinder 10. The member 8 serves to enclose a breathing bag 11 connected on the one hand to an outlet 12 from the canister 9, and on the other hand to an inlet 13 to the cooling tube 1. The other end of the cooling tube 1 is coupled to a breathing tube 14 leading to a mouthpiece 15, which mouthpiece is further coupled via an exhaust tube 16 to a conduit 17 leading to the canister 9. In conventional manner the mouthpiece 15 incorporates non-return valves, not shown, which operate in a direction such that air is inhaled from the tube 14 and exhaled to the tube 16.

The oxygen cylinder 10 comprises a supply valve and regulator 18 of conventional type, by means of which oxygen can be supplied at a controlled rate to the breathing bag 11.

In the operation of the device described, air breathed by the wearer is recirculated through the system in the direction indicated by the arrows. Thus, air from the breathing bag 11, containing oxygen supplied from the cylinder 10 is inhaled via pipe 1 and breathing tube 14, and then exhaled via tube 16 and conduit 17 to the canister 9 wherein carbon dioxide is absorbed from the air by the absorbent medium present in the canister 9, before the air returns to the breathing bag 11 to be recharged with oxygen from the cylinder 10. The air to be breathed is cooled by the tube 1 serving as a heat exchanger as described above in the case of the device of FIGS. 1–3. The temperature of the air to be breathed is thus determined by the boiling point of the refrigerant medium contained within the reservoir 2 and maintained under a predetermined vapour pressure by means of the adjustable relief valve 4. As in the case of the embodiment of FIGS. 1–3, the sensing tube 3 connected to the relief valve 4 communicates with the volumetric centre of the reservoir 2 which, as shown more clearly in FIG. 5, is less than half filled with refrigerant medium so that the refrigerant liquid cannot itself enter the tube 3.

The construction of the valve 4 is illustrated in more detail FIG. 6, wherein it will be seen that the sensing tube 3 engages with a valve body 25 fitted in the wall of the reservoir 2 and providing a valve seat 26 for a valve member 24 having a stem 24A guided within a bore 22A of an adjustable valve cap 22 in screw threaded engagement with the valve body 25. A compression spring 23 engages between the cap 22 and the valve member 24, and thus force of the spring, and the corresponding pressure at which the valve member 24 is released from the valve seat 26 is determined by the extent to which the cap 22 is screw threaded on to the valve body 25. The cap 22 incorporates a vent 27 to allow escape of refrigerant gas released by the valve member 24. A locking screw 21 serves to enable locking of the valve cap 22 in a selected position of adjustment.

The construction of the valve member 6 is substantially similar to that of the valve member 4 as illustrated in FIG. 6 with the exception that the sensing tube 3 is omitted.

What is claimed is:

1. A breathing apparatus comprising:

breathing means for permitting a user to inhale a breathable gaseous medium and exhale gases;

first conduit means connected at one end to said breathing means to establish a flow path for the breathable gaseous medium to be passed to a user for inhalation;

second conduit means having one end connected to said breathing means to establish a flow path for the exhaled gases;

regeneration means operatively coupled to the other ends of said first and second conduit means and in fluid communication therewith for accepting and regenerating said exhaled gases from said second conduit means so that breathable gaseous medium is discharged into said first conduit means; and cooling means downstream of said regeneration means for cooling said breathable medium, said cooling means including (a) a reservoir containing a predetermined volume of refrigerant liquid, a portion of said first conduit means being disposed in said reservoir in heat-exchange relationship with said refrigerant liquid, and (b) manually operable pressure relief valve means establishing fluid communication between said reservoir and the ambient environment, said valve means for permitting manual selection of a predetermined vapor pressure for the liquid refrigerant and to responsively control the temperature of the liquid refrigerant and thus the temperature of the breathable medium flowing through said first conduit means in heat-exchange relationship with said liquid refrigerant, wherein said valve means includes:

(i) a valve body defining a valve seat;

(ii) valve stem means in seated relationship against said valve seat to thus prevent fluid communication between said liquid refrigerant and said ambient environment when said liquid refrigerant exhibits a vapor pressure below said predetermined pressure yet is movable into spaced relationship with said valve seat to establish fluid communication between said liquid refrigerant and said ambient environment; and (iii) adjustable coupling means for coupling said valve stem means and said valve body, said coupling means for adjustably determining movement of said valve stem means from said seated relationship to said spaced relationship relative to said valve seat to thereby responsively permit selection of said predetermined vapor pressure of said liquid refrigerant.

2. A breathing apparatus as in claim 1 wherein said pressure relief valve means further includes an outlet conduit having one end coupled to said pressure relief valve means and another end disposed substantially at the volumetric center of said reservoir, the amount of said body of liquid refrigerant being such that said liquid refrigerant fills less than half of the volume of the said reservoir.

3. A breathing apparatus as in claim 1 wherein said liquid refrigerant exhibits a boiling point at atmospheric pressure which is below 40° C.

4. A breathing apparatus as in claim 1 wherein said pressure relief valve means enables the pressure within said reservoir to be set within a range of 1–21 bar absolute pressure.

5. A breathing apparatus as in claim 3, wherein said refrigerant liquid is selected from the group comprising types R11, R21 and R114.

6. A breathing apparatus of claim 1 wherein said predetermined volume of liquid refrigerant and an adjustable range of said pressure relief valve means are so selected that under normal ambient conditions said pressure relief valve means, in a corresponding setting, maintains a closure for said storage reservoir whereby a charge of said refrigerant medium is conserved ready for use.

7. A breathing apparatus as in claim 1 wherein said first conduit means includes a flexible breathing bag disposed upstream of said cooling means.

8. A breathing apparatus as in claim 7 further comprising a source of breathable gaseous medium in fluid communication with said breathing bag to replenish the supply of breathable medium flowing through said first conduit means.

9. A breathing apparatus as in claim 1 wherein said coupling means includes cap means threadably coupled to said valve body and biasing means operatively positioned between said cap means and said valve stem means for exerting a bias force against said valve stem means to urge said valve stem means into said seated relationship, said cap means for permitting selective adjustment of said bias force by virtue of its threaded coupling with said valve body whereby upon manual turning movement being applied to said cap means, said bias force is selectively adjusted.

* * * * *